US009845214B2

(12) United States Patent
Ui

(10) Patent No.: US 9,845,214 B2
(45) Date of Patent: Dec. 19, 2017

(54) IMAGE FORMING APPARATUS

(71) Applicant: Konica Minolta, Inc., Tokyo (JP)

(72) Inventor: Makoto Ui, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/836,388

(22) Filed: Aug. 26, 2015

(65) Prior Publication Data

US 2016/0060063 A1 Mar. 3, 2016

(30) Foreign Application Priority Data

Aug. 28, 2014 (JP) ..... 2014-174352

(51) Int. Cl.
*G03G 15/00* (2006.01)
*B65H 5/38* (2006.01)
*B65H 5/06* (2006.01)

(52) U.S. Cl.
CPC ..... *B65H 5/38* (2013.01); *B65H 5/062* (2013.01); *B65H 2402/10* (2013.01); *B65H 2404/143* (2013.01); *B65H 2404/1421* (2013.01); *B65H 2404/611* (2013.01); *B65H 2511/224* (2013.01); *B65H 2801/09* (2013.01)

(58) Field of Classification Search
None
See application file for complete search history.

(56) References Cited

U.S. PATENT DOCUMENTS 3,829,185 A * 8/1974 Lloyd ..... G01D 15/28 312/34.8
4,873,541 A * 10/1989 Hirose ..... G03G 15/0131 347/118
6,775,486 B2 * 8/2004 Matsuyama ..... G03G 15/70 399/18
8,941,849 B2 * 1/2015 Ohtsuka ..... H04N 1/0066 271/162
2010/0247136 A1 * 9/2010 Seto ..... B65H 1/266 399/107
2015/0298931 A1 * 10/2015 Osaki ..... B65H 43/00 271/265.01

FOREIGN PATENT DOCUMENTS

JP 04235857 A * 8/1992
JP 07053067 A * 2/1995
JP 2001356667 A 12/2001
JP 2007172014 A 7/2007

OTHER PUBLICATIONS

Machine translation of Sasaki, JP 2001-356667 (2001).*
Notice of Reasons for Rejection dated Sep. 27, 2016 for corresponding Japanese Application; Japanese Patent Application No. 2014-0174352; English translation of Notice of Reasons for Rejection; Total of 7 pages.

* cited by examiner

*Primary Examiner* — Sevan A Aydin
(74) *Attorney, Agent, or Firm* — Lucas & Mercanti, LLP

(57) ABSTRACT

An image forming apparatus includes: a sheet conveyance section configured to convey a long sheet along a sheet feeding path; and an image forming section configured to form an image on the long sheet conveyed by the sheet conveyance section, the sheet conveyance section including a conveyance unit that includes a first conveyance roller and a second conveyance roller for conveying the long sheet in a sandwiching manner, and is movable along a sheet conveyance direction in a state where the long sheet is conveyed through the sheet feeding path.

15 Claims, 7 Drawing Sheets

IMAGE FORMING APPARATUS

CROSS REFERENCE TO RELATED APPLICATIONS

This application is entitled to and claims the benefit of Japanese Patent Application No. 2014-174352, filed on Aug. 28, 2014, the disclosure of which including the specification, drawings and abstract is incorporated herein by reference in its entirety.

BACKGROUND OF THE INVENTION

1. Field of the Invention

The present invention relates to an image forming apparatus for forming an image on a long sheet.

2. Description of Related Art

Conventionally, image forming apparatuses (such as a printer, a copier, and a facsimile machine) which can form an image on a long sheet such as a roll sheet and a continuous sheet (continuous form paper) are known. For example, an electrophotographic image forming apparatus is configured to irradiate (expose) a uniformly-charged photoconductor (for example, a photoconductor drum) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet through an intermediate transfer belt, followed by heating and pressurization for fixing at a fixing section, whereby an image is formed on the sheet.

In general, the interior of an image forming apparatus is contaminated and damaged by paper dust and preprinted ink component, and therefore cleaning of the sheet feeding path is required. In particular, when an image is formed on a tack roll sheet (a roll sheet including a surface base material, adhesive, and a release sheet) used for making labels, adhesive that comes off from the sheet adheres to parts (for example, a conveyance roller and a conveyance guide disposed in the sheet width direction) that make contact with an end portion of the sheet, and therefore it is necessary to frequently clean up the sheet feeding path.

When the sheet feeding path is cleaned, the sheet feeding path is exposed by widely exposing the exterior portion of the image forming apparatus, or by pulling a sheet conveyance section including a conveyance roller section and a conveyance guide part in the sheet width direction from a front door of the image forming apparatus, for example (see, for example, Japanese Patent Application Laid-Open No. 2007-172014).

However, when the interior of the apparatus is exposed by widely exposing the exterior of the image forming apparatus to perform cleaning, a long sheet still presents in the sheet feeding path, and therefore the cleaning of the parts under the long sheet cannot be performed. In addition, since the cleaning has to be performed while avoiding the structural parts, it is difficult to ensure a sufficient space for the cleaning. Furthermore, in electrophotographic image forming apparatuses having complicated internal structures, parts which can be exposed are limited, and therefore the workability is poor.

In the case where cleaning is performed by pulling out the sheet conveyance section in the sheet width direction, the sheet conveyance section cannot be pulled when the long sheet exists in the feeding path since the long sheet is torn if the sheet conveyance section is pulled in the state where the long sheet exists in the feeding path. For this reason, the long sheet has to be removed from the sheet feeding path to pull out the sheet conveyance section, and thus removal of the long sheet and resupply of the sheet after the cleaning are required, and as a result, the cleaning operation is complicated.

SUMMARY OF THE INVENTION

An object of the present invention is to provide an image forming apparatus in which cleaning of a sheet feeding path can be readily performed when a long sheet is used.

To achieve at least one of the abovementioned objects, an image forming apparatus reflecting one aspect of the present invention includes: a sheet conveyance section configured to convey a long sheet along a sheet feeding path; and an image forming section configured to form an image on the long sheet conveyed by the sheet conveyance section, the sheet conveyance section including a conveyance unit that includes a first conveyance roller and a second conveyance roller for conveying the long sheet in a sandwiching manner, and is movable along a sheet conveyance direction in a state where the long sheet is conveyed through the sheet feeding path.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
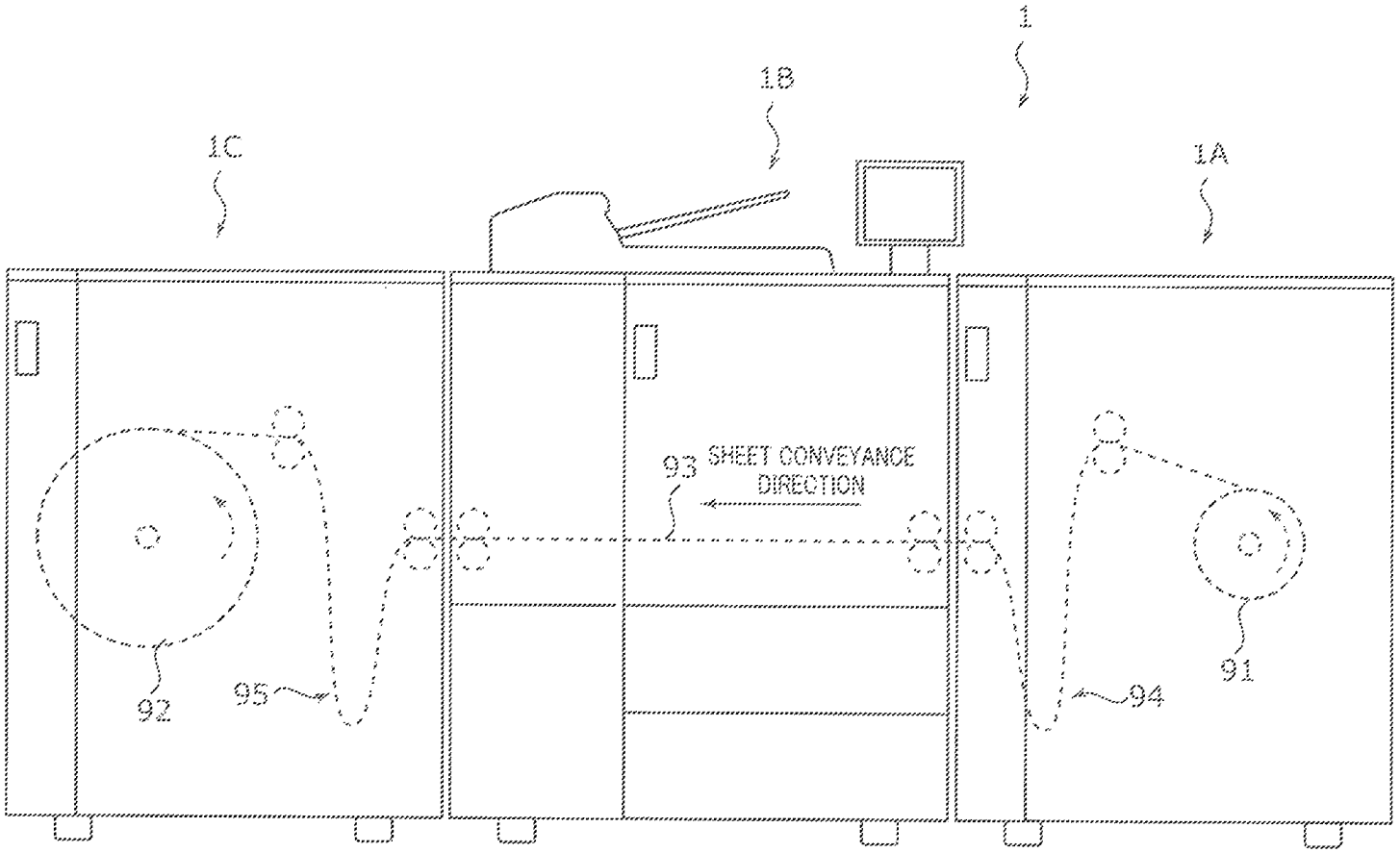
FIG. 1 illustrates an image forming apparatus according to an embodiment of the present invention.

FIG. 1 illustrates a configuration of image forming apparatus 1 according to the embodiment of the present invention.

Image forming apparatus 1 illustrated in FIG. 1 includes sheet feeding apparatus 1A, image forming apparatus main body 1B, and winding apparatus 1C. Image forming apparatus 1 forms an image on a roll sheet, and the present invention is suitable for an image forming apparatus that forms an image on a long sheet such as a roll sheet and a continuous sheet, that is, a sheet that is always being conveyed through a sheet feeding path.

Sheet feeding apparatus 1A includes roll sheet feeding section 91, sheet feeding side buffer section 94 and the like, and feeds a sheet under the instruction of image forming apparatus main body 1B. In sheet feeding side buffer section 94, for example, slackening of the roll sheet is absorbed with a vertically movable tension roller, an air blasting device that applies air to the roll sheet, a suction device that sucks the roll sheet or the like, and thus a proper tensile force is given to the roll sheet.

The roll sheet fed from sheet feeding apparatus 1A is conveyed along sheet feeding path 93. Image forming apparatus main body 1B forms an image on a roll sheet fed from sheet feeding apparatus 1A. The way of image formation of image forming apparatus main body 1B is not limited, and an electrophotographic method, an ink-jetting method, a thermal method or the like may be adopted. In the present embodiment, image forming apparatus main body 1B adopting an electrophotographic method will be described.

Winding apparatus 1C includes roll winding section 92 and winding side buffer section 95, and winds up a roll sheet on which an image has been formed by image forming apparatus main body 1B. Winding side buffer section 95 has a configuration similar to that of sheet feeding side buffer section 94.

Figure 2:
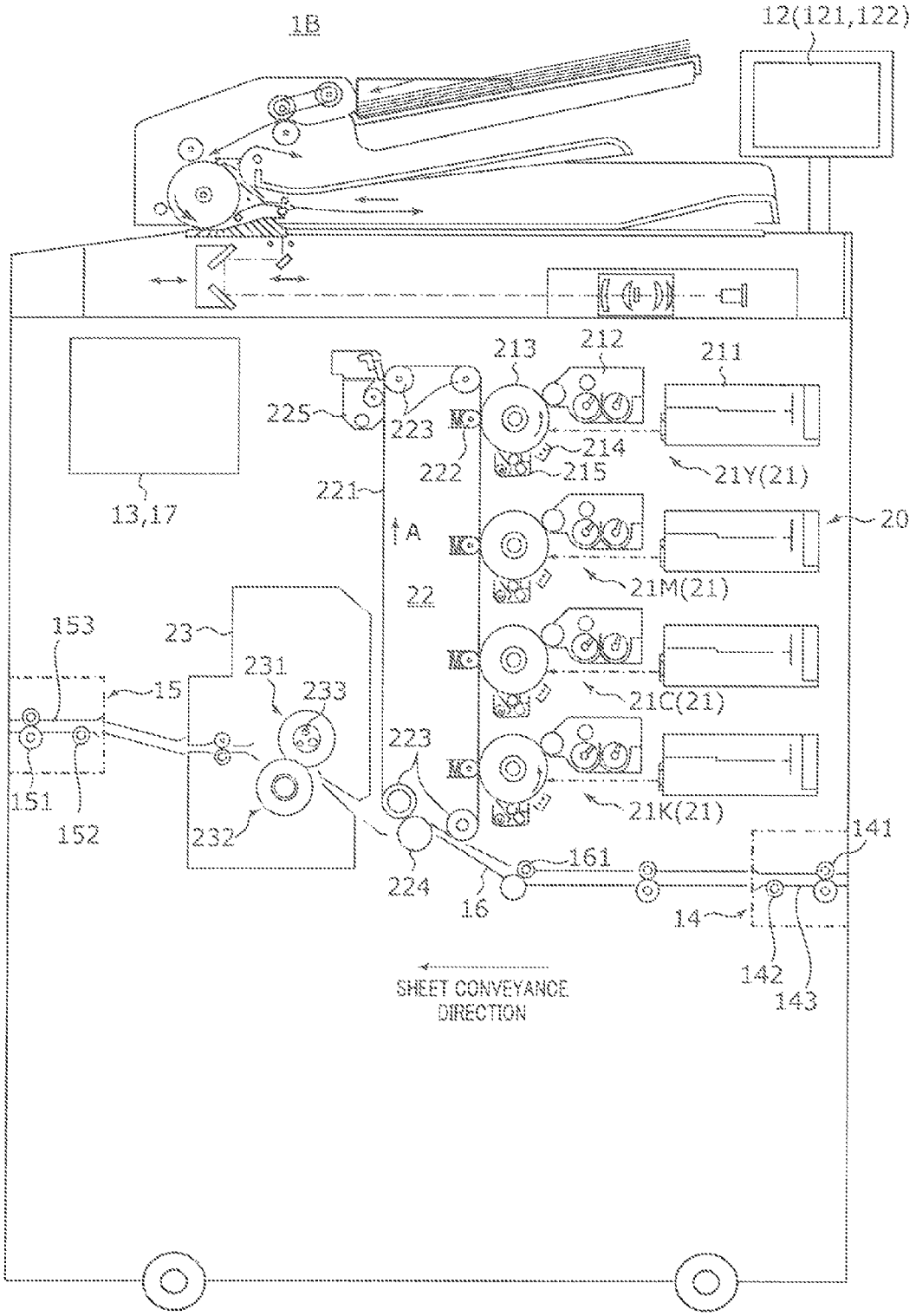
FIG. 2 illustrates a general configuration of an image forming apparatus main body.
Figure 3:
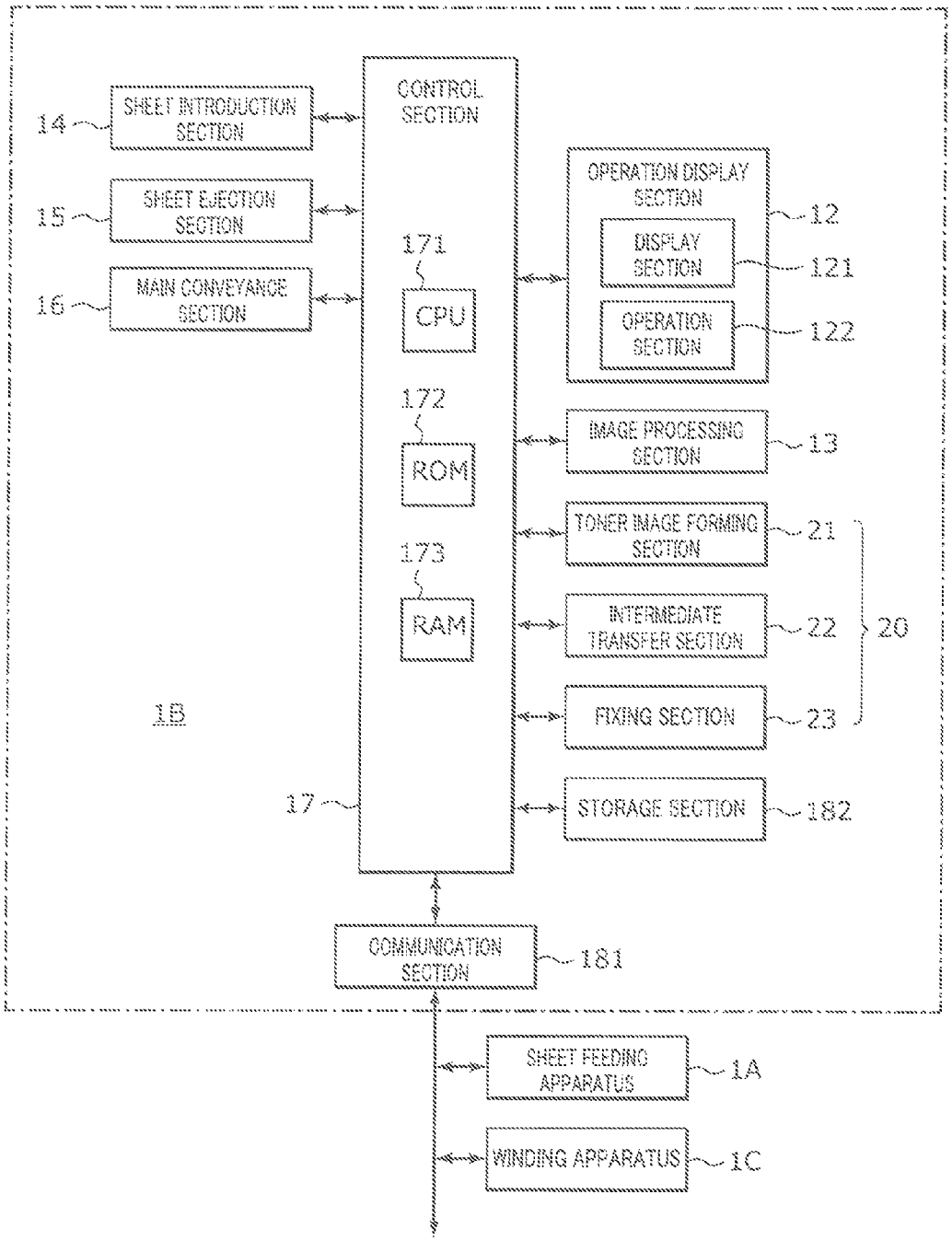
FIG. 3 illustrates a principal part of a control system of the image forming apparatus main body.

FIG. 2 illustrates a general configuration of image forming apparatus main body 1B. FIG. 3 illustrates a principal part of a control system of image forming apparatus main body 1B.

Image forming apparatus main body 1B illustrated in FIGS. 2 and 3 is a color image forming apparatus of an intermediate transfer system using electrophotographic process technology. A longitudinal tandem system is adopted for image forming apparatus main body 1B. In the longitudinal tandem system, respective photoconductor drums 213 corresponding to the four colors of YMCK are placed in series in the travelling direction (vertical direction) of intermediate transfer belt 221, and the toner images of the four colors are sequentially transferred to intermediate transfer belt 221 in one cycle.

That is, image forming apparatus main body 1B transfers (primary-transfers) toner images of yellow (Y), magenta (M), cyan (C), and black (K) formed on photoconductor drums 213 to intermediate transfer belt 221, and superimposes the toner images of the four colors on one another on intermediate transfer belt 221. Then, image forming apparatus main body 1B transfers (secondary-transfers) the resultant image to a sheet, to thereby form an image.

As illustrated in FIGS. 2 and 3, image forming apparatus main body 1B includes operation display section 12, image processing section 13, image forming section 20, sheet introduction section 14, sheet ejection section 15, main conveyance section 16, and control section 17.

Control section 17 includes central processing unit (CPU) 171, read only memory (ROM) 172, random access memory (RAM) 173 and the like. CPU 171 reads a program suited to processing contents out of ROM 172 or storage section 182, develops the program in RAM 173, and integrally controls the operation of each block of image forming apparatus 1B, sheet feeding apparatus 1A and winding apparatus 1C in cooperation with the developed program.

Communication section 181 has various interfaces such as network interface card (NIC), modulator-demodulator (MODEM), and universal serial bus (USB), for example.

Storage section 182 is composed of, for example, a non-volatile semiconductor memory (so-called flash memory) or a hard disk drive. Storage section 182 stores therein a look-up table which is referenced when the operation of each block is controlled, for example.

Control section 17 transmits and receives various data to and from an external apparatus (for example, a personal computer) connected to a communication network such as a local area network (LAN) or a wide area network (WAN), through communication section 181. Control section 17 receives image data (input image data) of page description language (PDL) that has been sent from an external device, and controls the apparatus to form an image on a sheet on the basis of the data, for example.

Operation display section 12 includes, for example, a liquid crystal display (LCD) with a touch panel, and functions as display section 121 and operation section 122. Display section 121 displays various operation screens, image conditions, operating statuses of functions, and the like in accordance with display control signals received from control section 17. Operation section 122 includes various operation keys such as numeric keys and a start key, receives various input operations performed by a user, and outputs operation signals to control section 17. By operating operation display section 12, the user can perform setting relating to the image formation such as document setting, image quality setting, multiplying factor setting, application setting, output setting, and sheet setting.

Image processing section 13 includes a circuit that performs a digital image process suited to initial settings or user settings on the input image data, and the like. For example, image processing section 13 performs tone correction on the basis of tone correction data under the control of control section 17. Image processing section 13 also performs various correction processes such as color correction and shading correction on the input image data. Image forming section 20 is controlled on the basis of the image data that has been subjected to these processes.

Image forming section 20 includes: toner image forming section 21 configured to form toner images of colored toners respectively containing a Y component, an M component, a C component, and a K component on the basis of the input image data; intermediate transfer section 22 configured to transfer a toner image formed by toner image forming sections 21 to a sheet; fixing section 23 configured to fix a transferred toner image to a sheet; and the like.

Toner image forming section 21 includes four toner image forming sections 21Y, 21M, 21C, and 21K for the Y component, the M component, the C component, and the K component, respectively. Since toner image forming sections 21Y, 21M, 21C, and 21K have similar configurations, common elements are denoted by the same reference signs for ease of illustration and description. Only when elements need to be discriminated from one another, Y, M, C, K is added to their reference signs. In FIG. 2, reference signs are given to only the elements of toner image forming section 21Y for the Y component, and reference signs are omitted for the elements of other toner image forming sections 21M, 21C, and 21K.

Toner image forming section 21 includes exposing device 211, developing device 212, photoconductor drum 213, charging device 214, drum cleaning device 215 and the like.

Photoconductor drum 213 is, for example, a negative-charge-type organic photoconductor (OPC) formed by sequentially laminating an under coat layer (UCL), a charge generation layer (CGL), and a charge transport layer (CTL)

on the circumferential surface of a conductive cylindrical body (aluminum-elementary tube) made of aluminum.

The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 211. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 214 is composed of a corona discharging generator such as a scorotron charging device and a corotron charging device, for example. Charging device 214 evenly negatively charges the surface of photoconductor drum 213 by corona discharge.

Exposing device 211 is composed of, for example, an LED print head including an LED array having a plurality of linearly laid out light-emitting diodes (LED), an LPH driving section (driver IC) for driving each LED, and an lens array that brings light radiated from the LED array into an image on photoconductor drum 213, and the like. Each of the LEDs of LED array 1 corresponds to one dot of an image.

Exposure device 211 irradiates photoconductor drum 213 with light corresponding to the image of each color component. The positive charge generated in the charge generation layer of photoconductor drum 213 irradiated with light is transported to the surface of the charge transport layer, whereby the surface charge (negative charge) of photoconductor drum 213 is neutralized. Thus, an electrostatic latent image of each color component is formed on the surface of photoconductor drum 213 by the potential difference from its surroundings.

Developing device 212 stores developers of respective color components (for example, a two-component developer composed of toner and magnetic carrier). Developing device 212 attaches toner of respective color components to the surfaces of photoconductor drums 213, and visualizes the electrostatic latent image to form a toner image. To be more specific, a developing bias voltage is applied to a developer bearing member (developing roller), and an electric field is formed between photoconductor drum 213 and developer bearing member. By the potential difference between photoconductor drum 213 and the developer bearing member, the charging toner on the developer bearing member is caused to move and attach to a light exposure section on the surface of photoconductor drum 213.

Drum cleaning device 215 includes a drum cleaning blade that is brought into sliding contact with the surface of photoconductor drum 213, and removes residual toner that remains on the surface of photoconductor drum 213 after the primary transfer.

Intermediate transfer section 22 includes intermediate transfer belt 221, primary transfer roller 222, a plurality of support rollers 223, secondary transfer roller 224, belt cleaning device 225 and the like.

Intermediate transfer belt 221 is composed of an endless belt, and is stretched around the plurality of support rollers 223 in a loop form. At least one of the plurality of support rollers 223 is composed of a driving roller, and the others are each composed of a driven roller. When driving roller rotates, intermediate transfer belt 221 travels in arrow A direction at a constant speed.

Primary transfer rollers 222 are disposed on the inner periphery side of intermediate transfer belt 221 in such a manner as to face photoconductor drums 213 of respective color components. Primary transfer rollers 222 are brought into pressure contact with photoconductor drums 213 with intermediate transfer belt 221 therebetween, whereby a primary transfer nip (hereinafter referred to as "primary transfer section") for transferring a toner image from photoconductor drums 213 to intermediate transfer belt 221 is formed.

Secondary transfer roller 224 is disposed on the outer periphery side of intermediate transfer belt 221 in such a manner as to face one of support rollers 223. In the plurality of support rollers 223, support roller 223 that is so disposed as to face intermediate transfer belt 221 is referred to as a backup roller (hereinafter referred to as "backup roller 223"). Secondary transfer roller 224 is brought into pressure contact with backup roller 223 with intermediate transfer belt 221 therebetween, whereby a secondary transfer nip (hereinafter referred to as "secondary transfer section") for transferring a toner image from intermediate transfer belt 221 to a sheet is formed.

In the primary transfer section, the toner images on photoconductor drums 213 are sequentially primary-transferred to intermediate transfer belt 221. To be more specific, a primary transfer bias is applied to primary transfer rollers 222, and electric charge of the polarity opposite to the polarity of the toner is applied to the rear side (the side that makes contact with primary transfer rollers 222) of intermediate transfer belt 221, whereby the toner image is electrostatically transferred to intermediate transfer belt 221.

Thereafter, when the sheet passes through the secondary transfer section, the toner image on intermediate transfer belt 221 is secondary-transferred to the sheet. To be more specific, a secondary transfer bias is applied to secondary transfer roller 224, and an electric charge opposite to that of the toner is applied to the rear side (the side that makes contact with secondary transfer roller 224) of the sheet, whereby the toner image is electrostatically transferred to the sheet. The sheet on which the toner image has been transferred is conveyed toward fixing section 23.

Belt cleaning device 225 includes a belt cleaning blade configured to make sliding contact with the surface of intermediate transfer belt 221, and the like, and removes transfer residual toner remaining on the surface of intermediate transfer belt 221 after the secondary transfer.

Alternatively, in intermediate transfer section 22, it is also possible to adopt a configuration (so-called belt-type secondary transfer unit) in which a secondary transfer belt is installed in a stretched state in a loop form around a plurality of support rollers including a secondary transfer roller in place of secondary transfer roller 224.

Fixing section 23 includes upper fixing section 231 having a fixing side member disposed on a fixing surface (the surface on which a toner image is formed) side of a sheet, lower fixing section 232 having a back side supporting member disposed on the rear surface (the surface opposite to the fixing surface) side of a sheet, heating source 233 configured to heat the fixing side member, a pressure contact separation section (not illustrated) configured to bring the back side supporting member into pressure contact with the fixing side member, and the like.

For example, when upper fixing section 231 is of a roller heating type, the fixing roller serves as the fixing side member, and when upper fixing section 231 is of a belt heating type, the fixing belt serves as the fixing side member. In addition, for example, when lower fixing section 232 is of a roller pressing type, the pressure roller serves as the back side supporting member, and when lower fixing section 232 is of a belt pressing type, the pressing belt serves as the back side supporting member. FIG. 2 illustrates a configuration in which upper fixing section 231 is of a roller heating type, and lower fixing section 232 is of a roller pressing type.

Upper fixing section 231 includes upper fixing section-driving section (not illustrated) for rotating the fixing side member. When control section 17 controls the operation of the upper fixing section-driving section, the fixing side member rotates (travels) at a predetermined speed. Lower fixing section 232 includes lower fixing section-driving section (not illustrated) for rotating the back side supporting member. When control section 17 controls the operation of the lower fixing section-driving section, the back side supporting member rotates (travels) at a predetermined speed. It is to be noted that, in the case where the fixing side member follows the rotation of the back side supporting member, the upper fixing section-driving section is not required.

Heating source 233 is disposed inside or near the fixing side member. When control section 17 controls the output of heating source 233, the fixing side member is heated, and maintained at a predetermined temperature (for example, a fixable temperature, or a fixation idling temperature). On the basis of the detection result of a fixing temperature detection section (not illustrated) disposed at a position near the fixing side member, control section 17 controls the output of heating source 233.

A pressure contact separation section (not illustrated) presses the back side supporting member against the fixing side member. The pressure contact separation section makes contact with both ends of a shaft that supports the back side supporting member to separately press each end. With this structure, the balance of the nip pressure in the direction along the shaft in the fixing nip can be adjusted. When control section 17 controls the operation of the pressure contact separation section (not illustrated) such that the back side supporting member is brought into pressure contact with the fixing side member, a fixing nip for conveying a sheet in a tightly sandwiching manner is formed.

Heat and pressure are applied to a sheet on which a toner image has been secondary-transferred and which has been conveyed along a sheet feeding path at the time when the sheet passes through fixing section 23. Thus, the toner image is fixed to the sheet.

Sheet introduction section 14 is configured as a unit (hereinafter referred to also as "sheet introduction unit 14") in which sheet introduction roller section 141, sheet-introduction rolling member 143, sheet introduction guide part 142 and the like are fixed to frame 144 (see FIG. 5) for example. Sheet introduction unit 14 is detachably mounted in image forming apparatus main body 1B, and is configured to send a roll sheet fed from sheet feeding apparatus 1A into main conveyance section 16.

Figure 4B:
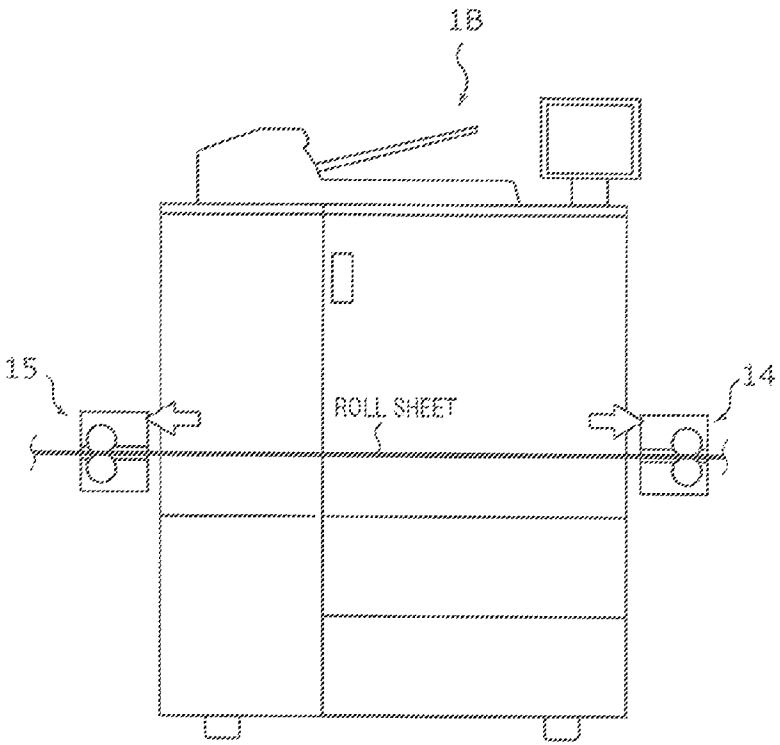
FIG. 4B illustrates a state where the sheet introduction unit and the sheet ejection unit are dismounted from the image forming apparatus.
Figure 4A:
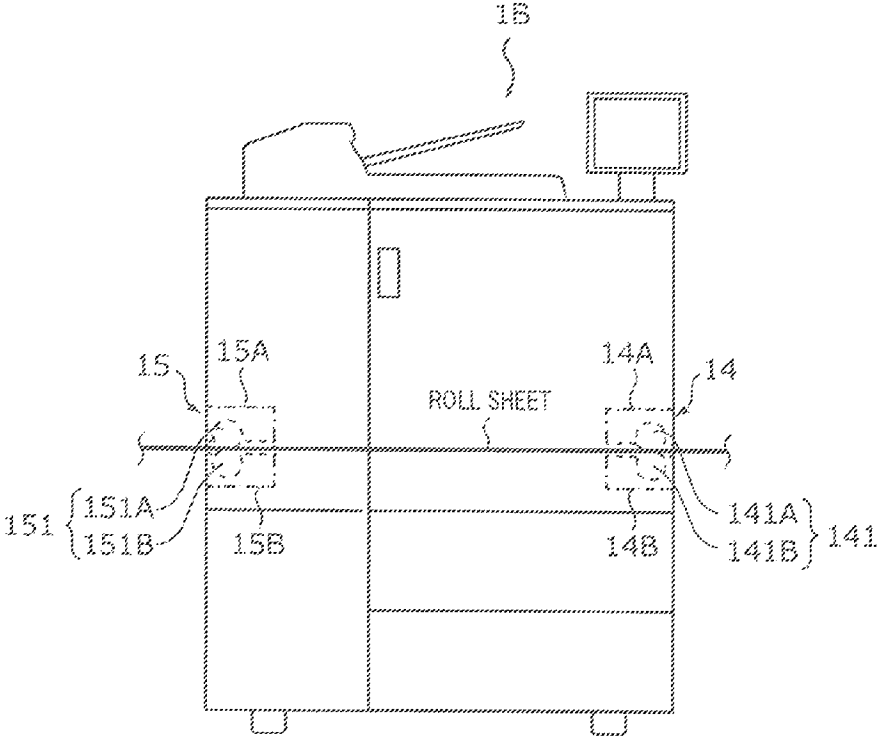
FIG. 4A illustrates a state where a sheet introduction unit and a sheet ejection unit are mounted in the image forming apparatus main body.

Sheet introduction roller section 141 includes a pair of rollers (upper sheet introduction roller 141A and lower sheet introduction roller 141B, see FIG. 4A and FIG. 4B) that are brought into pressure contact with each other. One of the rollers (here, upper sheet introduction roller 141A) is a drive roller, and the other (here, lower sheet introduction roller 141B) is a driven roller. Upper sheet introduction roller 141A and lower sheet introduction roller 141B are kept in a pressure contact state or a separated state by a pressure contact separation section (not illustrated).

Sheet-introduction rolling member 143 is disposed on the downstream side of sheet introduction roller section 141 in the sheet conveyance direction, and helps the conveyance of the roll sheet.

Sheet introduction guide part 142 includes a pair of guide members (upper side sheet introduction guide 142A and lower side sheet introduction guide 142B, see FIG. 5) that face each other in the vertical direction (a direction perpendicular to the surface of the roll sheet). The sheet feeding path in sheet introduction section 14 is configured by sheet introduction guide part 142.

Sheet ejection section 15 is configured as a unit (hereinafter referred to also as "sheet ejection unit 15") in which sheet ejection roller section 151, sheet ejection rolling member 152, sheet ejection guide part 153 and the like are fixed to a frame (not illustrated). Sheet ejection unit 15 is detachably mounted in image forming apparatus main body 1B, and is configured to send the roll sheet output from main conveyance section 16 into winding apparatus 1C. The configuration of sheet ejection section 15 is similar to that of sheet introduction section 14.

Sheet ejection roller section 151 includes a pair of rollers (upper sheet ejection roller 151A and lower sheet ejection roller 151B, see FIG. 4) that are brought into pressure contact with each other. One of the rollers (here, upper sheet ejection roller 151A) is a drive roller, and the other (here, lower sheet ejection roller 151B) is a driven roller. Upper sheet ejection roller 151A and lower sheet ejection roller 151B are kept in a pressure contact state or a separated state by a pressure contact separation section (not illustrated).

Sheet ejection rolling member 152 is disposed on the upstream side of sheet ejection roller section 151 in the sheet conveyance direction, and helps the conveyance of the roll sheet.

Sheet ejection guide part 153 includes a pair of guide members (an upper side sheet ejection guide and a lower side sheet ejection guide, not illustrated) that face each other in the vertical direction (a direction perpendicular to the surface of the roll sheet). The sheet feeding path in sheet ejection section 15 is configured by sheet ejection guide part 153.

Main conveyance section 16 includes a plurality of conveyance roller sections serving as sheet-conveyance elements for conveying sheets in a sandwiching manner. The conveyance roller sections include entry roller section 161 disposed on the upstream side of the secondary transfer section in the sheet conveyance direction. Main conveyance section 16 conveys a roll sheet introduced from sheet introduction section 14 through image forming section 20 (a secondary transfer section and fixing section 23), and conveys a sheet output from image forming section 20 (fixing section 23) toward sheet ejection section 15.

When an image is formed on a roll sheet, a roll sheet fed from sheet feeding apparatus 1A is introduced through sheet introduction section 14. The roll thus introduced is conveyed to image forming section 20 by sheet main conveyance section 16. Thereafter, a toner image on intermediate transfer belt 221 is secondary-transferred to a surface of the roll sheet at one time at the time when the roll sheet passes through the secondary transfer section, and then a fixing process is performed in fixing section 23. The roll sheet on which an image has been formed is ejected out of the apparatus from sheet ejection section 15, and wound by roll winding section 92 of winding apparatus 1C. As described, the sheet conveyance section of image forming apparatus main body 1B is configured by sheet introduction section 14, sheet ejection section 15, and main conveyance section 16.

Image forming apparatus 1 requires cleaning of sheet feeding path 93 since the interior of the apparatus is contaminated and damaged with paper dust and preprinted ink component. In particular, in the case where an image is formed on a tack roll sheet (a roll sheet having a surface base material, adhesive, and a release sheet) used for making labels, adhesive that comes off from the sheet adheres to parts (for example, sheet introduction roller section 141, sheet ejection roller section 151 and the like) that make contact with an end portion of the sheet, and therefore it is necessary to frequently clean up sheet feeding path 93.

The present embodiment adopts a configuration in which sheet introduction unit 14 and sheet ejection unit 15 can be readily mounted or dismounted to or from image forming apparatus main body 1B to facilitate the cleaning.

FIG. 4A illustrates a state where sheet introduction unit 14 and sheet ejection unit 15 are mounted in image forming apparatus main body 1B. FIG. 4B illustrates a state where sheet introduction unit 14 and sheet ejection unit 15 are dismounted from image forming apparatus main body 1B. Sheet introduction unit 14 and sheet ejection unit 15 correspond to "conveyance unit" of the embodiment of the present invention.

As illustrated in FIG. 4A and FIG. 4B, sheet introduction unit 14 includes upper sheet introduction unit 14A (first conveyance unit) in which upper sheet introduction roller 141A (first conveyance roller) is disposed, and lower sheet introduction unit 14B (second conveyance unit) in which lower sheet introduction roller 141B (second conveyance roller) is disposed. A roll sheet is conveyed between upper sheet introduction unit 14A and lower sheet introduction unit 14B.

Sheet ejection unit 15 includes upper side sheet ejection unit 15A (which corresponds to first conveyance unit) in which upper sheet ejection roller 151A (which corresponds to first conveyance roller) is disposed, and lower side sheet ejection unit 15B (which corresponds to second conveyance unit) in which lower sheet ejection roller 151B (which corresponds to second conveyance roller) is disposed. A roll sheet is conveyed between upper side sheet ejection unit 15A and lower side sheet ejection unit 15B.

In image forming apparatus main body 1B, sheet introduction unit 14 and sheet ejection unit 15 can be moved along the sheet conveyance direction, that is, can be mounted or dismounted to or from image forming apparatus main body 1B in a state where a roll sheet presents in the apparatus. It is to be noted that the phrase "can be moved along the sheet conveyance direction" means that the units can move in the "sheet conveyance direction" and "a direction opposite to the sheet conveyance direction."

Sheet introduction unit 14 and sheet ejection unit 15 each include an engaging part (for example rolling member not illustrated) that is slidably engaged with a guide part (for example, guide rail not illustrated) disposed in image forming apparatus main body 1B, and when the engaging parts slide along the guide part, sheet introduction unit 14 and sheet ejection unit 15 move along the sheet conveyance direction, for example.

As described, image forming apparatus 1 includes a sheet conveyance section (sheet introduction section 14, sheet ejection section 15, and main conveyance section 16) that conveys a roll sheet (long sheet) along the sheet feeding path, and image forming section 20 that forms an image on a roll sheet conveyed by the sheet conveyance section. The sheet conveyance section includes upper sheet introduction roller 141A (first conveyance roller) and lower sheet introduction roller 141B (second conveyance roller) for conveying a roll sheet, and includes sheet introduction unit 14 (conveyance unit) that can move along the sheet conveyance direction in a state where a roll sheet is being conveyed in the sheet feeding path. In addition, the sheet conveyance section includes upper sheet ejection roller 151A (first conveyance roller) and lower sheet ejection roller 141B (second conveyance roller) for conveying a roll sheet, and sheet ejection unit 15 (conveyance unit) that can move along the sheet conveyance direction in a state where a roll sheet is being conveyed in the sheet feeding path.

In image forming apparatus 1, sheet introduction unit 14 and sheet ejection unit 15 can be mounted or dismounted to or from image forming apparatus main body 1B without cutting the roll sheet, and therefore the cleaning of the sheet feeding path of sheet introduction unit 14 and sheet ejection unit 15 can be readily performed when a roll sheet is used. In addition, since it is not necessary to again convey the roll sheet, efficiency of the cleaning improves. In particular, image forming apparatus 1 is suitable for the case where a tack roll sheet is used.

In addition, upper sheet introduction unit 14A and lower sheet introduction unit 14B are connected with each other such that the interior of sheet introduction unit 14 can be exposed. Upper side sheet ejection unit 15A and lower side sheet ejection unit 15B are connected with each other such that the interior of sheet ejection unit 15 can be exposed.

With this configuration, components for sheet conveyance such as sheet introduction roller section 141 and sheet ejection roller section 151 can be readily exposed, and cleaning efficiency can be further improved.

The following describes specific configurations for exposing the interior of the units in sheet introduction unit 14 and sheet ejection unit 15. It is to be noted that, since sheet introduction unit 14 and sheet ejection unit 15 may have configurations similar to each other, only sheet introduction unit 14 will be described below.

Figure 5A:
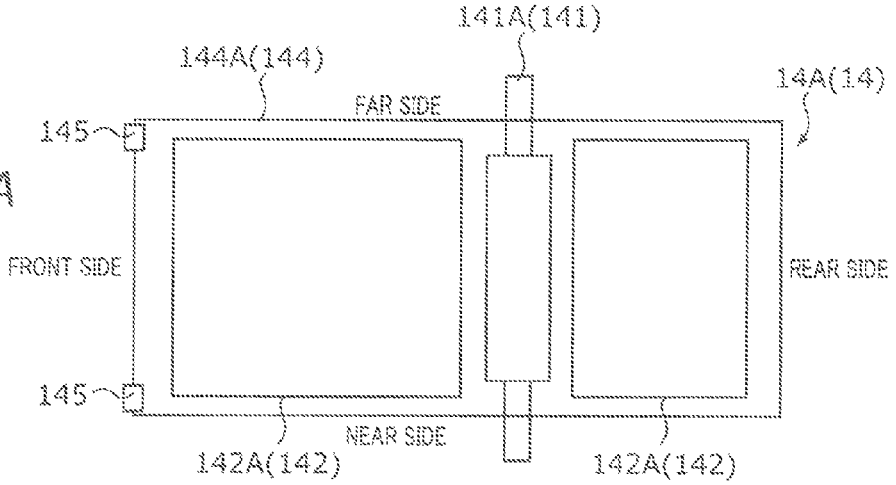
FIGS. 5A to 5C illustrate an example of the sheet introduction unit.
Figure 5B:
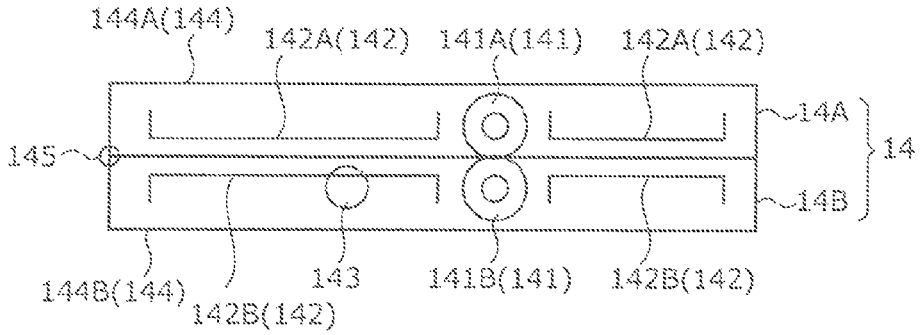
Figure 5C:
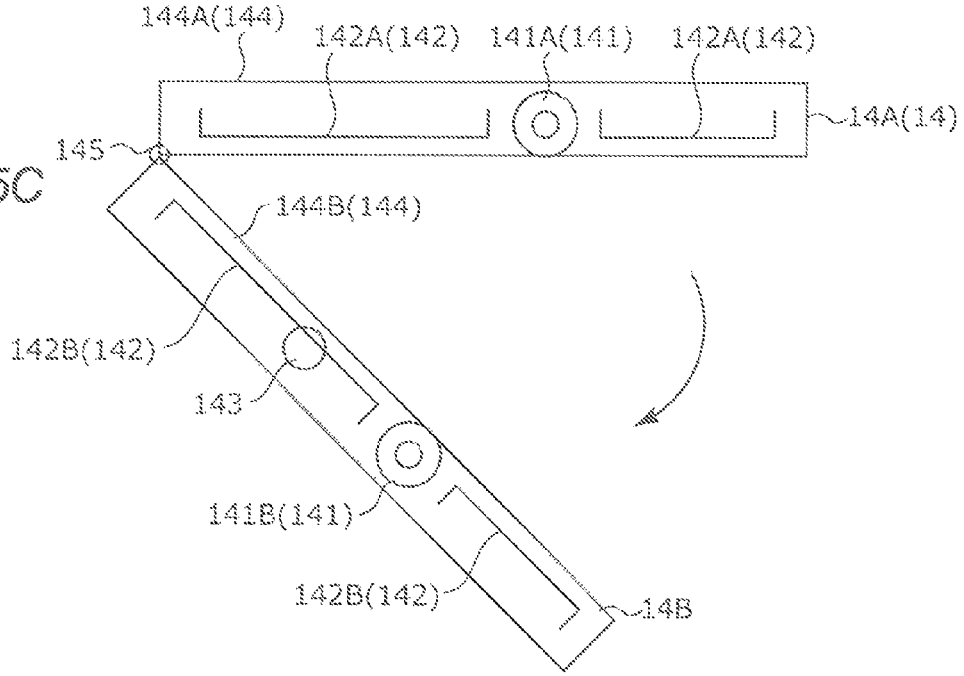

FIGS. 5A to 5C illustrate an exemplary sheet introduction unit 14. FIG. 5A is a plan view of sheet introduction unit 14 as viewed from upward. FIG. 5B is a side view of sheet introduction unit 14 as viewed from a near side (a front surface side of image forming apparatus main body 1B, or this side of FIG. 2). FIG. 5C is a front view illustrating a state where sheet introduction unit 14 is exposed. The left-and-right direction in FIGS. 5A to 5C is the sheet conveyance direction.

As illustrated in FIG. 5A to FIG. 5C, in upper sheet introduction unit 14A, upper sheet introduction roller 141A, upper side sheet introduction guide 142A and the like are attached to upper frame 144A, for example. In lower sheet introduction unit 14B, lower sheet introduction roller 141B, lower side sheet introduction guide 142B, sheet-introduction rolling member 143 and the like are attached to lower frame 144B.

Upper frame 144A and lower frame 144B are connected together with shaft part 145 (for example, a hinge) disposed at an one end in the sheet conveyance direction (here, an end on image forming apparatus main body 1B side). A locking part (not illustrated) configured to keep a closed state of sheet introduction unit 14 is provided at both ends in the sheet width direction or at the other end in the sheet conveyance direction of sheet introduction unit 14. Shaft parts 145 are disposed in a spaced relationship in the sheet width direction, and a roll sheet is conveyed therebetween.

At the time of cleaning of sheet introduction roller section 141 and the like, as illustrated in FIG. 5C, lower sheet introduction unit 14B is turned frontward with respect to upper sheet introduction unit 14A about shaft part 145, and the interior of sheet introduction unit 14 is exposed.

As described, upper sheet introduction unit 14A (first conveyance unit) and lower sheet introduction unit 14B (second conveyance unit) are connected together with shaft parts 145 disposed along the sheet width direction at an end in the sheet conveyance direction, and upper sheet introduction unit 14A or lower sheet introduction unit 14B turns about shaft part 145, whereby the interior of sheet introduction unit 14 (conveyance unit) is exposed. The same applies to sheet ejection unit 15.

With this configuration, the user can easily clean up the components for sheet conveyance such as sheet introduction roller section 141 and sheet ejection roller section 151.

Figure 6A:
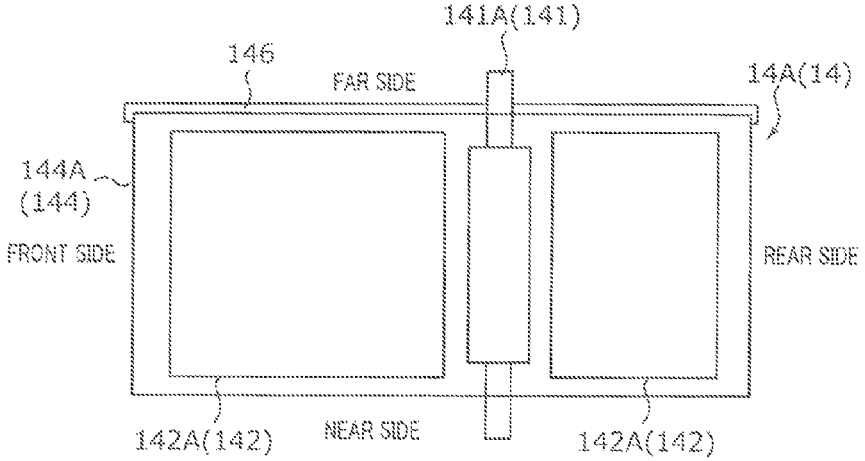
FIGS. 6A to 6C illustrate another example of the sheet introduction unit.
Figure 6B:
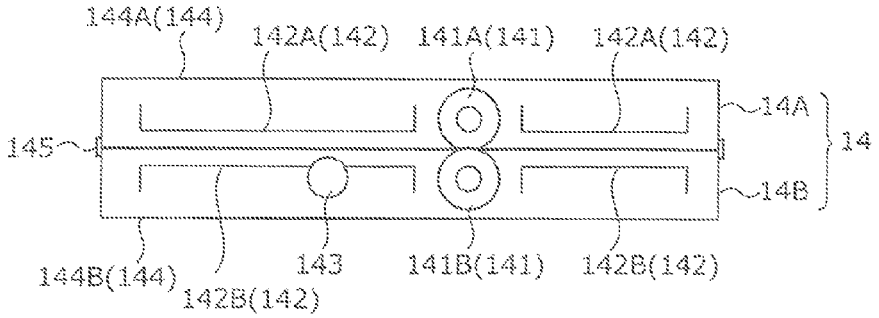
Figure 6C:
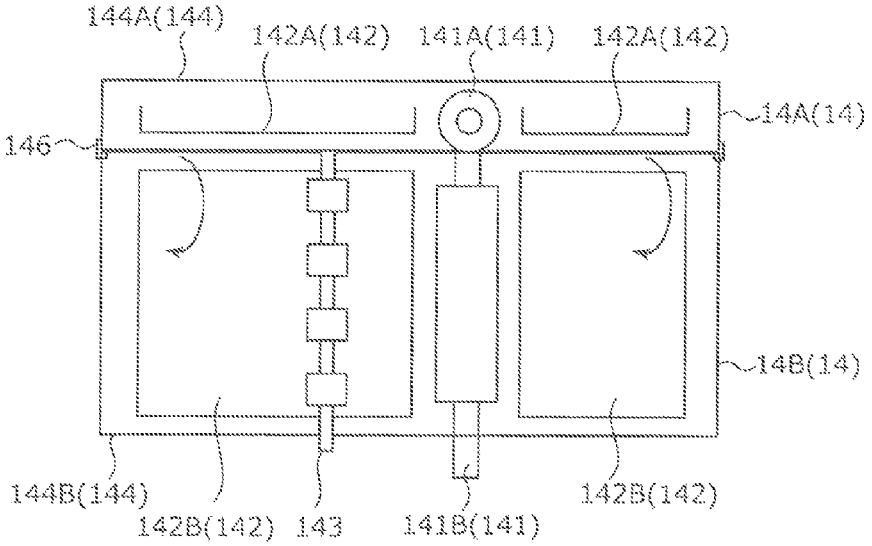

FIGS. 6A to 6C illustrate another example of sheet introduction unit 14. FIG. 6A is a plan view of sheet introduction unit 14 as viewed from upward. FIG. 6B is a side view of sheet introduction unit 14 as viewed from a near side (image forming apparatus main body 1B front surface side, in FIG. 2 paper surface front side). FIG. 6C is a front view illustrating a state where sheet introduction unit 14 is exposed. The horizontal direction in FIGS. 6A to 6C is the sheet conveyance direction.

In sheet introduction unit 14 illustrated in FIG. 6, upper frame 144A and lower frame 144B are connected together with a shaft part 146 (for example, a hinge) disposed at one end in the sheet width direction (here, an end of the far side on image forming apparatus main body 1B side). At both ends in the sheet conveyance direction or at the other end in the sheet width direction of sheet introduction unit 14, a locking part (not illustrated) for keeping a closed state of sheet introduction unit 14 is provided. Other configurations are similar to those of sheet introduction unit 14 illustrated in FIG. 5.

At the time of cleaning of sheet introduction roller section 141 and the like, lower sheet introduction unit 14B is turned to the far side with respect to upper sheet introduction unit 14A about shaft part 146 as illustrated in FIG. 6C, and the interior of sheet introduction unit 14 is exposed.

As described, upper sheet introduction unit 14A (first conveyance unit) and lower sheet introduction unit 14B (second conveyance unit) are connected together with shaft parts 146 disposed at an end in the sheet width direction along the sheet conveyance direction, and upper sheet introduction unit 14A or lower sheet introduction unit 14B turns about shaft part 145, whereby the interior of sheet introduction unit 14 (conveyance unit) is exposed. The same applies to sheet ejection unit 15.

With this configuration, the user can easily clean up the components for sheet conveyance such as sheet introduction roller section 141 and sheet ejection roller section 151.

When a roll sheet is pinched by sheet introduction roller section 141 or sheet ejection roller section 151 during operation for mounting or dismounting sheet introduction unit 14 and sheet ejection unit 15, the roll the roll sheet may be torn or slackened by being pulled. In view of this, when sheet introduction unit 14 and sheet ejection unit 15 are mounted or dismounted to or from image forming apparatus main body 1B, it is desired that the roll sheet be not pulled.

For example, upper sheet introduction roller 141A (first conveyance roller) and lower sheet introduction roller 141B (second conveyance roller) may be configured such that they are brought into a separation state from a pressure contact state when sheet introduction unit 14 (conveyance unit) is pulled out of the apparatus, and that they are brought into a pressure contact state from a separation state when sheet introduction unit 14 is mounted in the apparatus. In this case, the pressure contact separation section (not illustrated) may automatically control the rollers to perform pressure contact operation or separation operation along with mounting or dismounting of sheet introduction unit 14.

During mounting or dismounting of sheet introduction unit 14, upper sheet introduction roller 141A and lower sheet introduction roller 141B are kept in the separation state, and therefore the roll sheet is not pulled. As a result, the roll sheet can be prevented from being torn or slackened by being pulled. The same applies to sheet ejection unit 15.

In addition, for example, upper sheet introduction roller 141A (first conveyance roller) and lower sheet introduction roller 151A (second conveyance roller) may be configured to rotate in conjunction with the pulling operation when sheet introduction unit 14 (conveyance unit) is pulled out of the apparatus, and to rotate in conjunction with mounting operation when sheet introduction unit 14 is mounted in the apparatus.

Figure 7A:
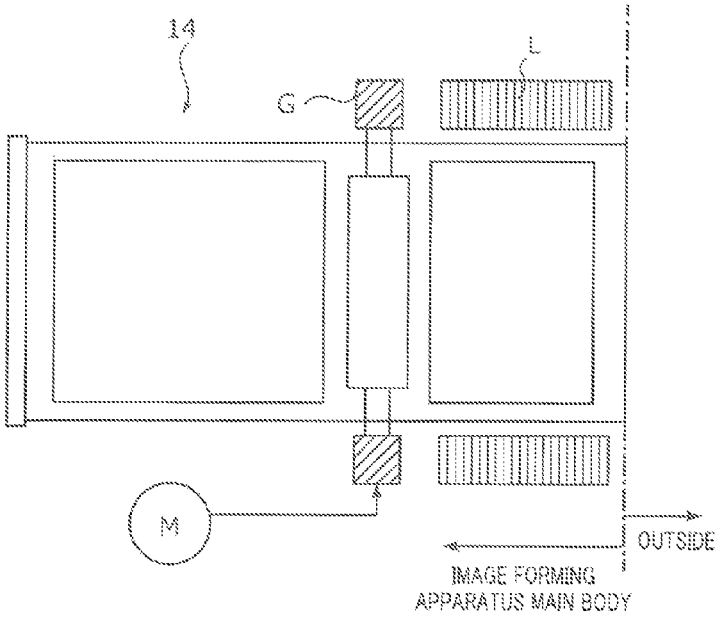
FIG. 7A illustrates a state where the sheet introduction unit is mounted in the image forming apparatus main body.
Figure 7B:
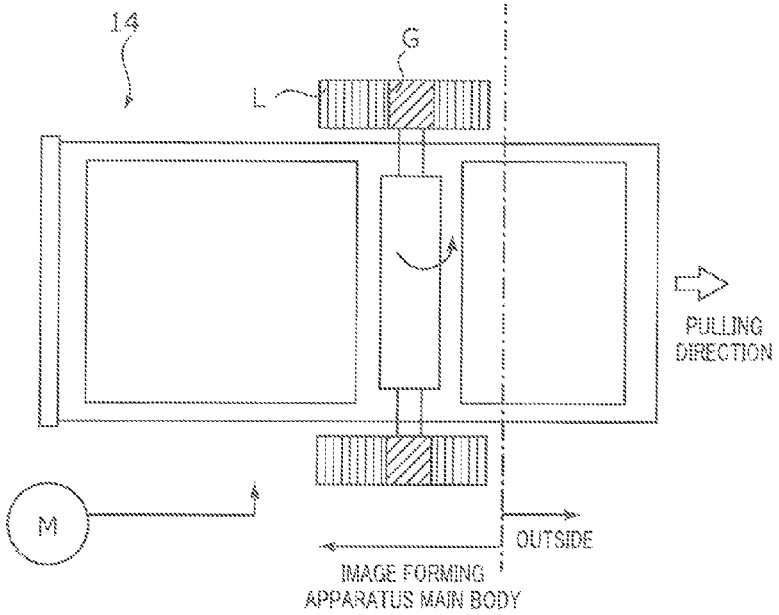
FIG. 7B illustrates a state where the sheet introduction unit is pulled out from the image forming apparatus main body.

As illustrated in FIG. 7A and FIG. 7B, pinion gear G may be disposed at both ends of the roller shaft of upper sheet introduction roller 141A serving as a drive roller such that pinion gear G is engaged with rack L disposed in image forming apparatus main body 1B along with mounting or dismounting of sheet introduction unit 14. When sheet introduction unit 14 is mounted in image forming apparatus main body 1B, the engaging state of pinion gear G and rack L is released, and pinion gear G is connected to conveyance drive motor M. That is, rack L is disposed in such a manner that the conveyance operation is not interfered.

Upper sheet introduction roller 141A rotates along the direction same as that of the sheet conveyance at the time when sheet introduction unit 14 is pulled out from image forming apparatus main body 1B, and rotates along the direction opposite to that of the sheet conveyance at the time when sheet introduction unit 14 is mounted in image forming apparatus main body 1B. The same applies to sheet ejection unit 15. Thus, the roll sheet can be prevented from being torn or slackened by being pulled.

Meanwhile, in the case of sheet ejection unit 15, upper sheet ejection roller 151A rotates along the direction opposite to that of the sheet conveyance at the time when sheet ejection unit 15 is pulled out from image forming apparatus main body 1B, and rotates along the direction same as that of the sheet conveyance at the time when sheet ejection unit 15 is mounted to image forming apparatus main body 1B.

In addition, when a roll sheet is slacken at the time when sheet introduction unit 14 or sheet ejection unit 15 is mounted to image forming apparatus main body 1B, conveyance error of the roll sheet may be caused. In view of this, it is preferable to perform sheet advancement prior to image formation by adjusting the drive timing of the conveyance roller section including sheet introduction roller section 141 and sheet ejection roller section 151. With this configuration, slack of the roll sheet is readily removed. The length corresponding to the sheet advancement is absorbed by buffer sections 94 and 95 provided in sheet feeding apparatus 1A and winding apparatus 1C.

While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, it is possible to adopt a configuration in which only one of sheet introduction unit 14 and sheet ejection unit 15 can be mounted or dismounted to or from image forming apparatus main body 1B. Further, it is possible to adopt a configuration in which a part of main conveyance section 16 can be mounted or dismounted to or from image forming apparatus main body 1B together with sheet introduction unit 14 or sheet ejection unit 15.

In addition, in sheet introduction unit 14 and sheet ejection unit 15, a guide part (side guide) that restricts the conveyance state of a roll sheet may be disposed at both ends in the sheet width direction. While, in the case where an image is formed on a tack roll sheet, the side guide is easily contaminated and damaged by adhesive that comes off from an end portion of the sheet in the width direction, the side guide can be readily cleaned up since sheet introduction unit 14 and sheet ejection unit 15 can be pulled out from image forming apparatus main body 1B.

The present invention is applicable not only to image forming apparatuses utilizing an image formation method described in the embodiment, but also to image forming apparatuses utilizing an ink jetting method and a thermal method.

The embodiment disclosed herein is merely an exemplification and should not be considered as limitative. The scope of the present invention is specified by the following claims, not by the above-mentioned description. It should be understood that various modifications, combinations, subcombinations and alterations may occur depending on design requirements and other factors in so far as they are within the scope of the appended claims or the equivalents thereof.

What is claimed is:

1. An image forming apparatus comprising:

a sheet conveyance section configured to convey a long sheet along a sheet feeding path; and an image forming section configured to form an image on the long sheet conveyed by the sheet conveyance section, the sheet conveyance section including a conveyance unit that includes a first conveyance roller and a second conveyance roller for conveying the long sheet in a sandwiching manner, the conveyance unit being movable between a mounted state, in which the conveyance unit is mounted in the apparatus, and a dismounted state, in which the conveyance unit is pulled out of the apparatus, along a sheet conveyance direction when the long sheet is conveyed through the sheet feeding path without cutting the long sheet.

2. The image forming apparatus according to claim 1, wherein the first conveyance roller and the second conveyance roller are brought into a separation state from a pressure contact state when the conveyance unit is pulled out from the apparatus, and are brought into the pressure contact state from the separation state after the conveyance unit is mounted in the apparatus.

3. The image forming apparatus according to claim 1, wherein the first conveyance roller and the second conveyance roller rotate relative to the conveyance unit when the conveyance unit is pulled out from the apparatus in conjunction with the pulling out of the conveyance unit, and rotate relative to the conveyance unit when the conveyance unit is mounted in the apparatus in conjunction with the mounting of the conveyance unit.

4. The image forming apparatus according to claim 1, wherein the conveyance unit includes a sheet introduction unit configured to introduce the long sheet to the image forming apparatus.

5. The image forming apparatus according to claim 1, wherein the conveyance unit includes a sheet ejection unit configured to eject the long sheet from the image forming apparatus.

6. The image forming apparatus according to claim 1, wherein the conveyance unit includes a guide part disposed along the sheet conveyance direction at both ends in the sheet width direction, and configured to restrict a conveyance state of the long sheet.

7. The image forming apparatus according to claim 1, wherein the image forming section forms an image on the long sheet by utilizing an electrophotographic method.

8. The image forming apparatus according to claim 1, wherein the conveyance unit is movable between a mounted state, in which the conveyance unit is mounted in the apparatus, and a pulled out state, in which the conveyance unit is pulled out of the apparatus, and one of the first conveyance roller and the second conveyance roller includes a shaft with at least one pinion at an end thereof, the pinion being in driving engagement with a motor when the conveyance unit is in the mounted state and being disconnected from the motor in the pulled out state.

9. The image forming apparatus according to claim 1, wherein the conveyance unit includes a first conveyance unit in which the first conveyance roller is disposed, and a second conveyance unit in which the second conveyance roller is disposed, and the first conveyance unit and the second conveyance unit are connected together such that an interior of the conveyance unit is allowed to be exposed.

10. The image forming apparatus according to claim 9, wherein the first conveyance unit and the second conveyance unit are connected by a support shaft having a longitudinal axis extending in a sheet width direction, the support shaft being disposed at one end of the conveyance unit in the sheet conveyance direction, and the interior of the conveyance unit is exposed when the first conveyance unit or the second conveyance unit turns about the support shaft.

11. The image forming apparatus according to claim 9, wherein the first conveyance unit and the second conveyance unit are connected by a support shaft having a longitudinal axis extending in a sheet conveyance direction, the support shaft being disposed at one end of the conveyance unit in a sheet width direction, and the interior of the conveyance unit is exposed when the first conveyance unit or the second conveyance unit turns about the support shaft.

12. An image forming apparatus comprising:

a sheet conveyance section configured to convey a long sheet along a sheet feeding path;

an image forming section configured to form an image on the long sheet conveyed by the sheet conveyance section, the sheet conveyance section including a conveyance unit that includes a first conveyance roller and a second conveyance roller for conveying the long sheet in a sandwiching manner, the conveyance unit being movable along a sheet conveyance direction in a state where the long sheet is conveyed through the sheet feeding path, wherein the conveyance unit is movable between a mounted state, in which the conveyance unit is mounted in the apparatus, and a pulled out state, in which the conveyance unit is pulled out of the apparatus, and one of the first conveyance roller and the second conveyance roller includes a shaft with at least one pinion at an end thereof, the pinion being in driving engagement with a motor when the conveyance unit is in the mounted state and being disconnected from the motor in the pulled out state, and a rack, wherein the pinion is disengaged with the rack when the conveyance unit is in the mounted position and the pinion engages with the rack when the conveyance unit is moved to or from the pulled out position so that the one of the first conveyance roller and the second conveyance roller rotates when the conveyance unit is moved to or from the pulled out position.

13. The image forming apparatus according to claim 12, wherein the conveyance unit includes a first conveyance unit in which the first conveyance roller is disposed, and a second conveyance unit in which the second conveyance roller is disposed, and the first conveyance unit and the second conveyance unit are connected together such that an interior of the conveyance unit is allowed to be exposed.

14. The image forming apparatus according to claim 13, wherein the first conveyance unit and the second conveyance unit are connected by a support shaft having a longitudinal axis extending in a sheet width direction, the support shaft being disposed at one end of the conveyance unit in the sheet conveyance direction, and the interior of the conveyance unit is exposed when the first conveyance unit or the second conveyance unit turns about the support shaft.

15. The image forming apparatus according to claim 13, wherein the first conveyance unit and the second conveyance unit are connected by a support shaft having a longitudinal axis extending in a sheet conveyance direction, the support shaft being disposed at one end of the conveyance unit in a sheet width direction, and the interior of the conveyance unit is exposed when the first conveyance unit or the second conveyance unit turns about the support shaft.

* * * * *